US006637716B2

(12) United States Patent
Wear

(10) Patent No.: US 6,637,716 B2
(45) Date of Patent: Oct. 28, 2003

(54) CLASP FOR HANGING MATERIAL

(75) Inventor: Stuart C. W. Wear, St. Louis Park, MN (US)

(73) Assignee: Popco, Inc, Minnetonka, MN (US)

( * ) Notice: Subject to any disclaimer, the term of this patent is extended or adjusted under 35 U.S.C. 154(b) by 0 days.

(21) Appl. No.: 10/125,884

(22) Filed: Apr. 19, 2002

(65) Prior Publication Data

US 2002/0125397 A1 Sep. 12, 2002

Related U.S. Application Data

(63) Continuation-in-part of application No. 09/619,596, filed on Jul. 19, 2000, now Pat. No. 6,450,471.

(51) Int. Cl.[7] ..... A47G 1/16

(52) U.S. Cl. ..... 248/489; 248/316.7; 24/67.9; 24/563; 40/649

(58) Field of Search ..... 248/489, 316.7, 248/316.5, 316.1, 495; 40/649, 658; 24/563, 545, 3.12, 67.9

(56) References Cited

U.S. PATENT DOCUMENTS

| | | | |
|---|---|---|---|
| 1,301,885 | A | 4/1919 | Tobiason et al. |
| 2,826,387 | A | 3/1958 | Rutten |
| 2,888,765 | A | 6/1959 | Knox |
| 3,324,585 | A | 6/1967 | Frederickson |
| 3,354,564 | A | 11/1967 | Falcone |
| 3,497,074 | A | 2/1970 | Shaheen |
| 3,561,077 | A | 2/1971 | Grant |
| 3,955,296 | A | 5/1976 | Kapstad |
| 4,315,611 | A | 2/1982 | Hoop |
| 4,341,028 | A | 7/1982 | Brown |
| 4,556,183 | A | 12/1985 | Greenberger |
| 4,882,862 | A | 11/1989 | Slavsky |
| 4,899,974 | A | 2/1990 | Wear |
| 5,145,140 | A | 9/1992 | Caston |
| 5,337,987 | A | 8/1994 | Sawatsky |
| 5,718,402 | A | 2/1998 | Hoffman |
| 5,863,019 | A | 1/1999 | Rose et al. |
| D424,120 | S | 5/2000 | Wear |

OTHER PUBLICATIONS

Imago Display System Brochure, 1 page.
Brügmann Catalog, 2 pages.

*Primary Examiner*—Korie Chan
(74) *Attorney, Agent, or Firm*—Patterson, Thuente, Skaar & Christensen, P.A.

(57) ABSTRACT

A poster clasp for suspending a poster includes a suspension assembly having at least one suspension device for operable, suspending cooperation with a surface; and a clasp assembly being formed integrally, unitarily with the suspension assembly, the clasp assembly having a support member and a hinged gripping member, the support member having a cam point formed integral with a backplate, and the hinged gripping member having a hingedly rotatable compression fin, the compression fin being rotatable between an open disposition and a closed disposition, the compression fin being formed integral with a hinge and being formed of a relatively soft material. A method of engaging a poster for the suspension thereof by means of a poster clasp is further included.

9 Claims, 4 Drawing Sheets

CLASP FOR HANGING MATERIAL

RELATED APPLICATIONS

This application is a continuation-in-part of application Ser. No. 09/619,596 filed Jul. 19, 2000 now U.S. Pat. No. 6,450,471.

TECHNICAL FIELD

Present invention relates to clasps. More particularly, the present invention relates to clasps for grasping and suspending material such as posters, signage and the like.

BACKGROUND OF THE INVENTION

There is a need for devices that grip posters and signage for suspension of the posters and signage from the devices. Such devices may be suspended by means of cords from a ceiling of a room or may be affixed to a wall of a room. The clips should be designed to readily receive and engage the posters such that the posters may be frequently changed as desired. The clips should have sufficient friction and/or compressive force to bear the weight of the poster in suspension.

There are a number of clips in use for the aforementioned purposes. One of such clips is as described in U.S. Pat. No. 4,899,974 issued Feb. 13, 1990 and assigned to the assignee of the present application.

Certain prior art clips have failed to meet certain needs of the industry. The first such need is to provide sufficient clamping engagement to support the weight of a suspended poster. In the past, certain designs of the prior art have not evidenced sufficient friction or compressive forces and posters had been known to pull free of the clip. Accordingly, there is a need in the industry to increase the friction and/or compression forces exerted by the clip on the poster.

A second need of the industry is to provide for ready insertion of the poster stock into the opening defined in the clip. Certain prior art clips required prying the clip away from a back plate to define an opening. Certain other prior art devices had a hinged clip but the hinge did not have a very extensive range of angular motion and accordingly the opening that was able to be defined was not very great. In both cases, inserting the poster into the clip was something akin to threading the eye of a needle.

A third need is to be able to engage the clip with the poster stock without crumpling the inserted portion of the poster stock in the receiving space defined within the clip. There are a number of different kinds of poster stock that are typically used. Some of such stock is relatively slippery-coated stocks, typically having an aqueous coating or being laminated. A further stock is uncoated paper. A final stock is formed of a much softer material that has a much higher coefficient friction. Such stock might be formed of PVC material. In the past, especially with a hinged clip, the engaging portion of the clip would early engage the soft stock. Due to the increased coefficient of a friction, continued rotation of the clip into the engaging position acted to carry the greater portion of the soft stock into the receiving space defined within the clip. The effect is then that the clip crumples the portion of the soft stock that is carried into the receiving space defined within the clip.

SUMMARY OF THE INVENTION

The present invention substantially meets the aforementioned needs of the industry. The retention of the poster within the clamp is enhanced in at least three ways. First, the clip is hinged and has a cammed portion that engages the poster compressively. Further, the point of engagement of the hinged clip bears on a ramped non-skid (high friction) portion. The ramp (cam point) provides for the camming of the hinged portion, while the non-skid material increases the friction existing between the surface of the poster stock and the back plate of the clamp.

Secondly, as indicated above, the engaging portion of the clamp is hinged. The actual hinge is preferably formed of a material that provides for a substantially increased range of rotational motion of the hinged portion. In such manner, a relatively large opening is defined to facilitate insertion of the poster stock into the receiving space defined within the clamp. Additionally, the hinged portion of the clamp includes a C-shaped (or backwards J-shaped) engaging member. The C-shaped engaging member generally defines a funnel when the hinged portion is in the open position. The funnel assists in guiding the poster stock into the receiving space defined within the clamp.

Thirdly, the design of the hinged portion of the clamp is such that the peak pressure exerted on the poster stock is delayed until the latter portion of the rotation of the hinged portion into the closed (engaged) disposition. The delay of the peak pressure exerted on the poster stock facilitates minimizing the crumpling of the portion of the poster stock that is caught up by the hinged portion of the clamp and carried into the receiving space defined within the clamp. Delaying the peak compressive force until the latter portions of rotation of the hinged portion is a method of minimizing the crumpling of poster stock, especially the relatively soft, high frictional poster stock.

The present invention is a poster clasp for suspending a poster includes a suspension assembly having at least one suspension device for operable, suspending cooperation with a surface; and a clasp assembly being formed integrally, unitarily with the suspension assembly, the clasp assembly having a support member and a hinged gripping member, the support member having a cam point formed integral with a backplate, and the hinged gripping member having a hingedly rotatable compression fin, the compression fin being rotatable between an open disposition and a closed disposition, the compression fin being formed integral with a hinge and being formed of a relatively soft material. The present invention is further a method of engaging a poster for the suspension thereof by means of a poster clasp.

DETAILED DESCRIPTION OF THE DRAWINGS

Figure 1:
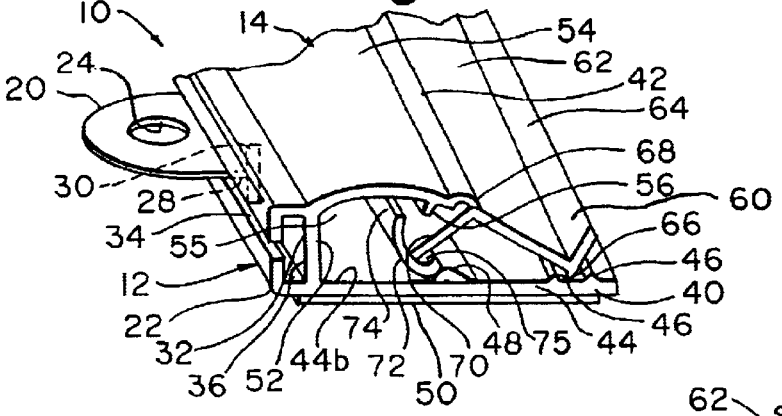
FIG. 1 is a perspective view of an embodiment of the poster clasp of the present invention.

The poster clasp of the present invention is shown generally at 10 in the figures. Poster clasp 10 has two major components that include suspension assembly 12 and clasp assembly 14.

The suspension assembly 12 includes a clip 20 and a clip receiver 22. The clip 20 has a clip aperture 24 defined therein. The clip aperture 24 is useful for passing a cord there through to suspend the poster clasp 10 from a room ceiling or other structure. Additionally, a fastener such as a screw or hook (see FIG. 6) may be passed through the clip aperture 24 and engaged with a room wall to support the poster clasp 10 in fixed engagement with the room wall.

The clip 20 includes a slidable retainer 26. The slidable retainer 26 may be generally defined by an inverted T shape (see FIGS. 1–4) having a shank 28 and a crossbar 30 coupled to the shank 28.

The clip receiver 22 has a receiver groove or rail 32 defined therein. The rail 22 extends preferably the full width of the poster clasp 10. In a preferred embodiment, a slot 34 extends through the suspension assembly and intersects the rail 32. The rail 32 preferably has an open end 36 at least on a first end of the suspension assembly 12.

In operation, the clip 20 of FIGS. 1–4 is inserted into the rail 32 via the open end 36. The slidable retainer 26 is captured within the rail 32 and the shank 28 of the clip 20 projects through the slot 34 to extend upward therefrom when the poster clasp 10 is in a suspended disposition. A plurality of clips 20 may be disposed within the rail 32 as desired and due to the slidable relationship of the clip 20 to the clip receiver 22, the clip 20 may be positioned as desired within receiver rail 32.

Figure 4:
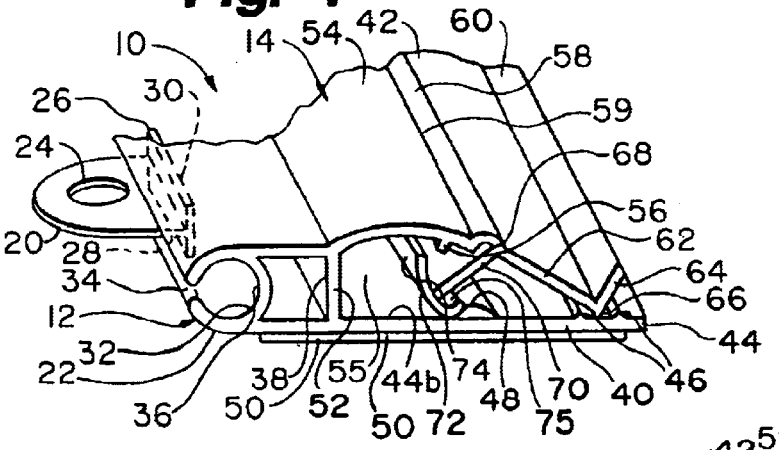
FIG. 4 is a perspective view of a further embodiment of the poster clasp of the present invention.
Figure 5:
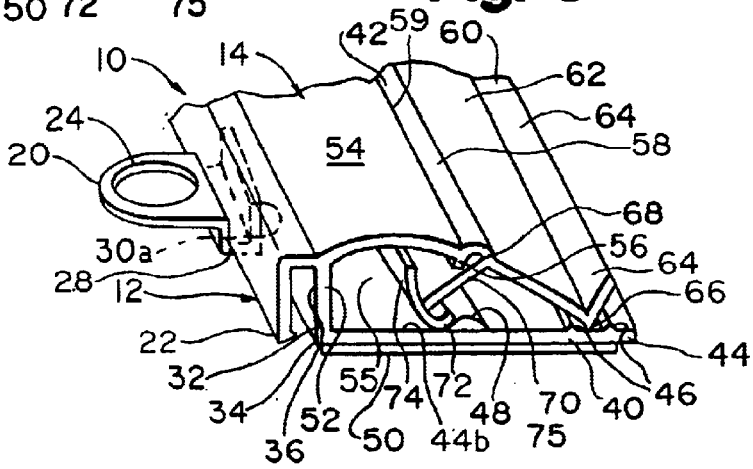
FIG. 5 is a perspective view of a further embodiment of the poster clasp of the present invention.

Referring to FIGS. 4 and 5, alternative embodiments of a suspension assembly 12 may be used with the clasp assembly 14. In the depiction of FIG. 4, the suspension assembly 12 has a receiver rail 32 that is generally circular in cross section. A clip 20 that is similar to the previously described clip 20 may be inserted within the circular receiver rail 32. An enclosed connector rail 38 resides beneath the circular receiver rail 32. The connector rail 38 is preferably open on both ends. In operation, an elongate connector bar (not shown) can be slid partially into the connector rail 38 of a first poster clasp 10 and partially into the connector rail 38 of a second poster clasp 10 in order to connect two adjacent poster clasps 10 together to support a poster that is longer than a standard length poster clasp 10.

Referring to FIG. 5, the suspension assembly 12 again includes both a clip 20 and a clip receiver 22. The clip 20 has a depending shank 28. The shank 28 forms a generally L shape with the crossbar 30A. The receiver rail 32 has a side opening slot 34 for receiving the cross bar 30A therein.

The poster clasp 10 is a unitary, integral design preferably formed in a single extruding step with the suspension assembly 12 and the clasp assembly 14 both being formed during that step. As indicated above, the clasp assembly 14 may be used with a number of different suspension assemblies 12.

Turning now to the description of the clasp assembly 14 of the poster clasp 10, the clasp assembly 14 has two subcomponents; support member 40 and hinged gripping member 42. The support member 40 of the clasp assembly 14 includes a back plate 44. The back plate 44 has an outer margin 44A and an opposed inner margin 44B. The outer and inner margins 44A, 44B are generally planar and extend the full width of the poster clasp 10. In a preferred embodiment, a pair of gripping ridges 46 are formed on the inner margin 44B. The gripping ridges 46 are spaced slightly apart and preferably extend the full width of the poster clasp 10.

A raised ramp or cam point 48 is also formed on the inner margin 44B. The cam point 48 preferably extends the full width of the poster clasp 10 and may be both lower and wider than as depicted. The cam point 48 is co-extruded with the extrusion that forms the poster clasp 10. The material forming the cam point 48 is generally softer than the material forming the rest of the poster clasp 10 and accordingly has a lower durometer number than the rest of the poster clasp 10, durometer being a measurement used to denote the hardness of a material (usually of thermosetting and thermoplastic materials) Notwithstanding the fact that the material forming the remainder of the poster clasp 10 and forming the cam point 48 are different, they are capable of being co extruded. The fact that the durometer number of the cam point 48 is reduced contributes to the fact that the friction existing between the cam point 48 and poster stock to be suspended from the poster clasp 10 is greater than would exist between the poster stock and a material of higher durometer number. This effectively increases the retaining potential of the poster clasp 10 exerted on poster stock inserted therein.

A tape strip 50 (see FIGS. 1–5) may be applied to the outer margin 44A of the back plate 44. The tape strip 50 typically has adhesive on both sides that is preferably covered by a release liner (not shown). A first release liner is removed from the tape strip 50 exposing the adhesive on a first side of the tape strip 50. That side may be then adhered to the outer margin 44A. The release liner of the opposing side of the tape strip 50 is kept in place until immediately prior to adhering the poster clasp 10 to a room wall surface or the like.

A cross member 52 is formed generally transverse to the back plate 44 and extends from the upper margin of the back plate 44. A hinge support 54 depends from the cross member 52 and is spaced apart from the back plate 44. A receiving aperture 55 is defined generally by the inner margin 44A of the back plate 44, the inner margin of the cross member 52, and the inner margin of the hinge support 54.

Preferably, the hinge support 54 has a generally arcuate shape and extends the full width of the poster clasp 10. A strengthening rib 56 that also extends the full width of the poster clasp 10 may be formed on the inner margin of the hinge support 54. One or more of such strengthening ribs 56 may be utilized in this manner as needed. The strengthening rib may be placed closed to the distal end margin of the hinge support (see FIGS. 2, 2*a* and 5) or may be spaced apart from the distal end margin of the hinge support (see FIGS. 1, 1*a,* and 4).

A preferably arched hinge 58 is integrally formed between the support member 40 and the hinged gripping member 42. The hinge 58 is preferably formed at a lower margin 59 of the hinge support 54. The material forming the hinge 58 is preferably the same material as forms the cam point 48 and is therefore generally softer than the material forming the rest of the poster clasp 10 and accordingly has a lower durometer number than the rest of the poster clasp 10

Notwithstanding the fact that the material forming the remainder of the poster clasp 10 and forming the arched hinge 58 are different, they are capable of being co extruded. The fact that the durometer number of the arched hinge 58 is reduced contributes to the fact that the arched hinge 58 has a relatively great range of rotational motion between an open disposition and a closed disposition, which, as will be seen contributes to forming a wide opening for the insertion of poster stock into the poster clasp 10.

The hinged gripping member 42 includes a gripping leg 60. The gripping leg 60 generally has the features of a human leg and will be so described. Accordingly, the gripping leg 60 has a lower leg portion 62 that is connected to a foot 64 at an intersection comprising a heel 66. Preferably, the foot 64 is disposed at an angle relative to the lower leg portion 62 of between 45 and 135 degrees. In the depiction of FIG. 1, a preferred included angle defined between the foot 64 and the lower leg portion 62 is about 100 degrees.

An upper leg portion 70 is joined to the lower leg portion 62 at a knee 68. It should be noted that the hinge 58 is fixedly joined to the gripping leg 60 proximate the knee 68. The upper leg portion 70 has an arcuate or C-shaped lobe 72 disposed at the distal end of the upper leg portion 70. The distal end of the upper leg portion 70 is joined to the lobe 72 approximately midway through the arc defined by the lobe 72. The outer margin 74 of the lobe 72 is preferably convex while the inner margin 75 of the lobe 72 is preferably concave. It is the outer margin 74 of the lobe 72 that compressively, frictionally engages the poster stock that is suspended from the poster clasp 10.

Figure 1A:
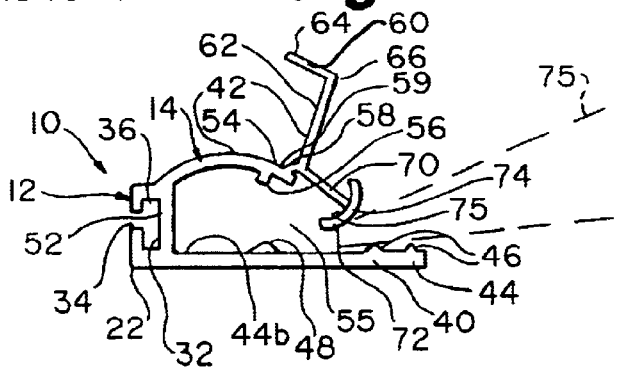
FIG. 1*a* is an end elevational view of the poster clasp of claim 1.
Figure 2:
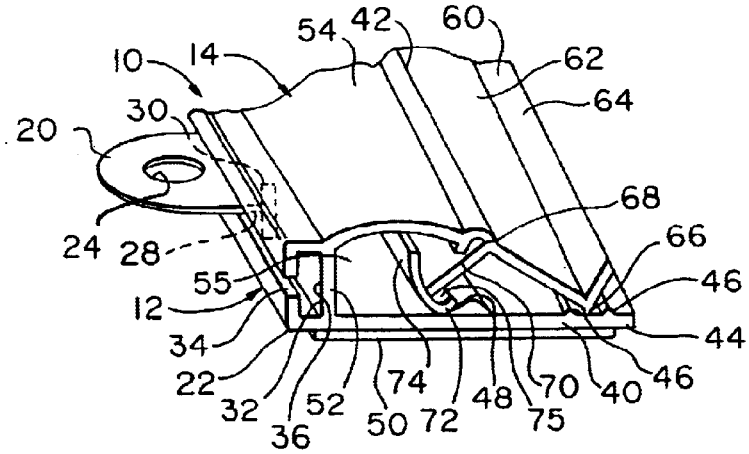
FIG. 2 is a perspective view of another embodiment of the poster clasp of the present invention.
Figure 2A:
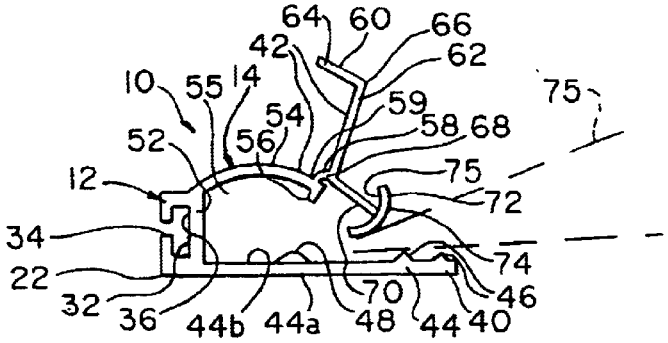
FIG. 2*a* is an end elevational view of the poster clasp of claim 2.
Figure 3:
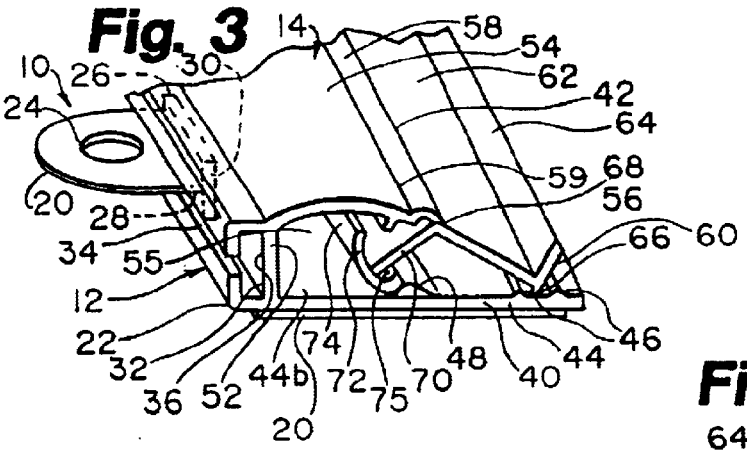
FIG. 3 is a perspective view of another embodiment of the poster clasp of the present invention.
Figure 3A:
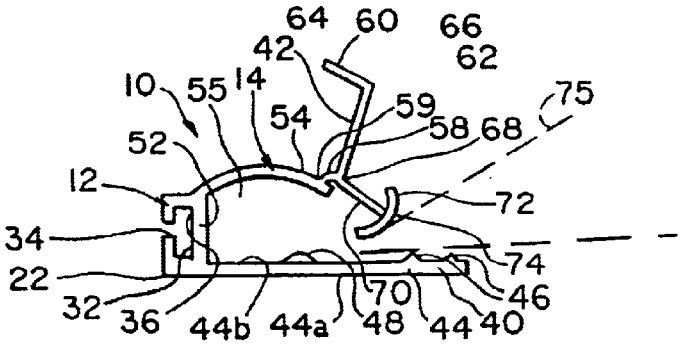
FIG. 3*a* is an end elevational view of the poster clasp of claim 3.

Rotation of the gripping leg 60 relative to the hinge support 54 is preferably through an arc that commences at the open disposition, as depicted in FIGS. 1A, 2A, 3A, and terminates at the closed disposition, as depicted in FIGS. 1, 2, 3. The rotation is through an arc between about 45 degrees and 135 degrees, and is most preferably between about 80 and 110 degrees. Engagement with the poster stock that is inserted into the receiving aperture 55 is dependent to a certain degree on the thickness of the poster stock, but generally first occurs on outer margin 74 somewhat prior to the point of intersection of the upper leg portion 70 with the lobe 72. As rotation of the gripping leg 60 is continued, compression of the poster stock increases to a peak pressure that occurs somewhat slightly after the point of intersection of the upper leg portion 70 with the lobe 72. As the lobe 72 passes beyond the cam point 48, pressure on the poster stock decreases somewhat.

At the same time, the heel 66 comes into engagement with the poster stock adjacent the inner margin 44B of the back plate 44 and compresses a portion of the poster stock between the two gripping ridges 46. This forces the ridges 46 to bite into the poster stock. Accordingly, it is the pressure exerted by the trailing portion of the lobe 72 acting on the poster stock captured between the trailing portion of the lobe 72 and the cam point 48 in cooperation with the pressure exerted by the heel 66 on the poster stock, forcing the poster stock into the gripping ridges 46 that acts to retain the poster stock within the poster clasp 10. By delaying the point of maximum compression between the lobe 72 and the cam point 48 until late in the rotation of the lobe 72 between the open disposition of FIGS. 1A, 2A, 3A and the closed disposition of FIGS. 1, 2, 3, the tendency to jam a greater portion of the poster stock into the receiving aperture 55 and to crumple such portion is greatly reduced.

Referring to FIGS. 1A, 2A, 3A, where the gripping leg 60 is depicted in the fully open disposition, it is apparent that the lobe 72 creates a funnel 75 that decreases in width dimension as the poster stock is inserted into the receiving aperture 55. The effect of the funnel 75 so defined is to better facilitate inserting the poster stock into the receiving aperture 55. The funnel effect is created by including in the design the arcuate, C-shaped lobe 72 in conjunction with the hinge 58. The hinge 58 permits a relatively large range of motion with the gripping leg 60 which acts to define a relatively large opening, as depicted in FIGS. 1A, 2A, 3A for the insertion of the poster stock into the receiving aperture 55. The curvature of the lobe 72 acts to create the funnel effect into the opening defined between the lobe 72 and the inner margin 45B of the back plate 44.

Figure 6:
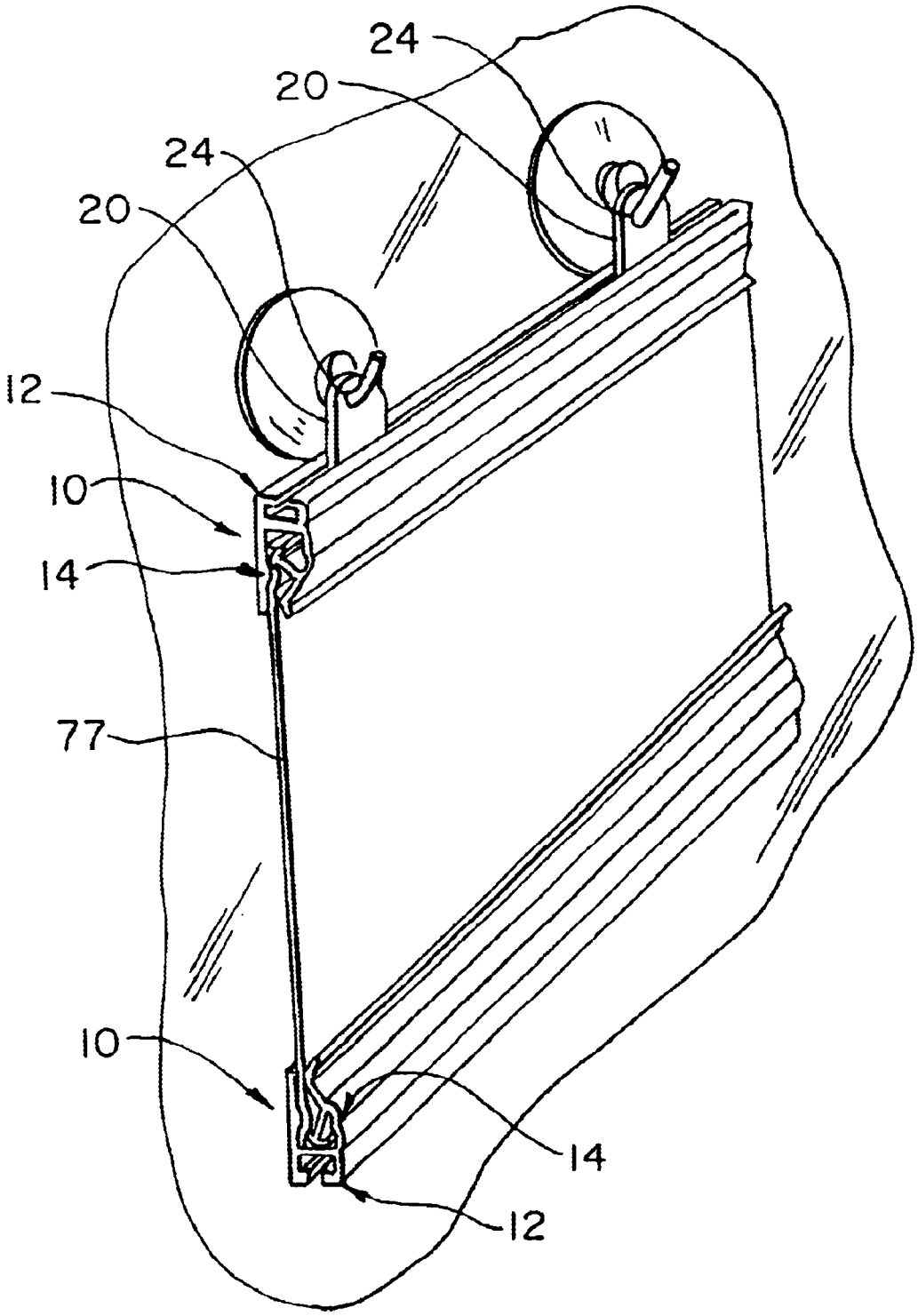
FIG. 6 is a perspective view of an embodiment of the poster clasp of the present invention supporting a poster, with a second poster clasp to weigh the poster down.

As depicted in FIG. 6 a first poster clasp 10 can be used to suspend a poster 77 therefrom while a second poster clasp 10 can be disposed on the bottom margin of the poster to generate a certain mass and stiffness at the lower margin of the poster 77 that aids in displaying the poster 77 in a planar manner. No clips 20 are usually utilized with the lower poster clasp 10.

Figure 7:
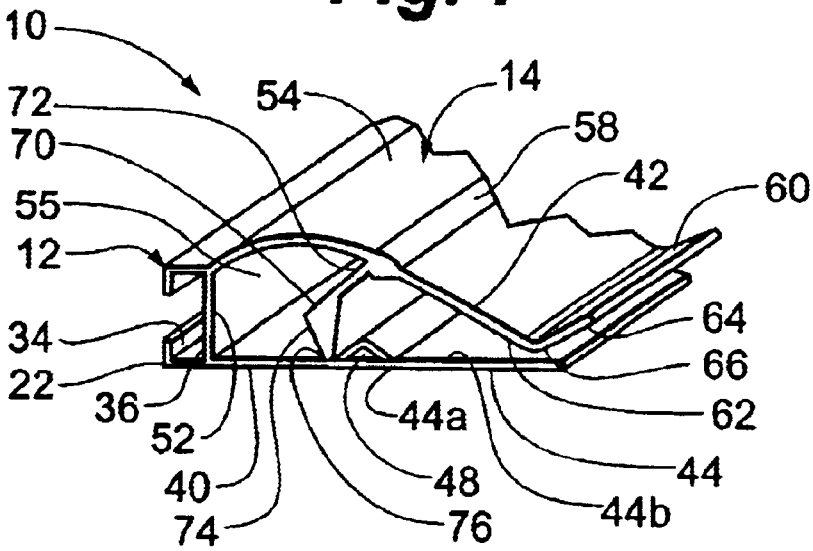
FIG. 7 is a perspective view of a further preferred embodiment of the poster clasp of the present invention in the closed disposition.
Figure 8:
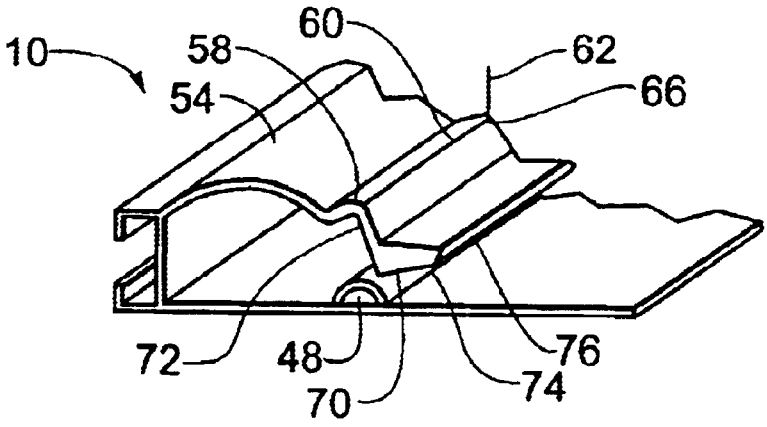
FIG. 8 is a perspective view of the embodiment of the poster clasp of the present invention of FIG. 7 in the open disposition.

As depicted in FIGS. 7 and 8, the clasp assembly 14 of the poster clasp 10, the clasp assembly 14 has two subcomponents; support member 40 and hinged gripping member 42. The support member 40 of the clasp assembly 14 includes a back plate 44. The back plate 44 has an outer margin 44*a* and an opposed inner margin 44*b*. The outer and inner margins 44*a*, 44*b* are generally planar and extend the full width of the poster clasp 10.

A raised ramp or cam point 48 is also formed on the inner margin 44*a*. The cam point 48 preferably extends the full width of the poster clasp 10 and may be both lower and wider than as depicted. The cam point 48 is co-extruded with the extrusion that forms the poster clasp 10. The material forming the cam point 48 is generally softer than the material forming the rest of the poster clasp 10 and accordingly has a lower durometer number than the rest of the poster clasp 10, durometer being a measurement used to denote the hardness of a material (usually of thermosetting and thermoplastic materials) Notwithstanding the fact that the material forming the remainder of the poster clasp 10 and forming the cam point 48 are different, they are capable of being co extruded. In this case, the cam point is preferably formed of a relatively soft material as compared to the material of the back plate 44, and is preferably PVC material. Alternatively, the cam point 48 is formed of the same material of the back plate 44 and is preferably a substantially rigid PVC material.

A tape strip 50 (see FIGS. 1–5) may be applied to the outer margin 44A of the back plate 44. The tape strip 50 typically has adhesive on both sides that is preferably covered by a release liner (not shown). A first release liner is removed from the tape strip 50 exposing the adhesive on a first side of the tape strip 50. That side may be then adhered to the outer margin 44A. The release liner of the opposing side of the tape strip 50 is kept in place until immediately prior to adhering the poster clasp 10 to a room wall surface or the like.

A cross member 52 is formed generally transverse to the back plate 44 and extends from the upper margin of the back plate 44. A hinge support 54 depends from the cross member 52 and is spaced apart from the back plate 44. A receiving aperture 55 is defined generally by the inner margin 44*a* of the back plate 44, the inner margin of the cross member 52, and the inner margin of the hinge support 54.

Preferably, the hinge support 54 has a generally arcuate shape and extends the full width of the poster clasp 10. A preferably arched hinge 58 is integrally formed between the support member 40 and the hinged gripping member 42. The hinge 58 is preferably formed at a lower margin of the hinge support 54. The material forming the hinge 58 is preferably generally softer than the material forming the rest of the poster clasp 10 and accordingly has a lower durometer number than the rest of the poster clasp 10 Notwithstanding the fact that the material forming the remainder of the poster clasp 10 and forming the arched hinge 58 are different, they are capable of being co extruded. The fact that the durometer number of the arched hinge 58 is reduced contributes to the fact that the arched hinge 58 has a relatively great range of rotational motion between an open disposition and a closed disposition, which, as will be seen contributes to forming a wide opening for the insertion of poster stock into the poster clasp 10.

The hinged gripping member 42 includes a gripping leg 60. The gripping leg 60 has a lower leg portion 62 that is connected to a foot 64 at an intersection comprising a heel. A compression fin 70 is joined to the lower leg portion 62. It should be noted that the hinge 58 is also fixedly joined to the gripping leg 60 proximate to point of connection of the compression fin 70. The compression fin 70 has a fin leg 72 that is preferably formed integral with the hinge 58, and accordingly, the compression fin 70 is preferably formed of a relatively soft material, preferably PVC.

The distal end of the fin leg is connected to foot 74. The toe 76 of the foot 74 is designed to compressively, frictionally engage the poster stock that is suspended from the poster clasp 10.

Rotation of the gripping leg 60 relative to the hinge support 54 is preferably through an arc that commences at the open disposition, as depicted in FIG. 8, and terminates at the closed disposition, as depicted in FIG. 7. The rotation is through an arc between about 45 degrees and 135 degrees, and is most preferably between about 80 and 110 degrees. Engagement with the poster stock that is inserted into the receiving aperture 55 is dependent to a certain degree on the thickness of the poster stock, but generally first occurs on the toe 76. As rotation of the gripping leg 60 is continued, compression of the poster stock increases to a peak pressure at appoint that is disposed on a line that is orthogonal with the back plate 44 and intersects the hinge 48. As the foot 74 passes beyond the cam point 48, pressure on the poster stock decreases somewhat.

At the same time, the heel 66 comes into engagement with the poster stock adjacent the inner margin 44*b* of the back plate 44 and compresses a portion of the poster stock. Accordingly, it is the pressure exerted by the toe 76 acting on the poster stock captured adjacent the cam point 48 in cooperation with the pressure exerted by the heel 66 on the poster stock that acts to retain the poster stock within the poster clasp 10. By delaying the point of maximum compression between the toe 76 and the cam point 48 until late in the rotation of the compression fin 70, there is a reduced tendency for the toe 76 to gather and to jam a greater portion of the poster stock into the receiving aperture 55 and to crumple such portion.

It will be obvious to those skilled in the art that other embodiments in addition to the ones described herein are indicated to be within the scope and breadth of the present application. Accordingly, the applicant intends to be limited only by the claims appended hereto.

What is claimed is:

1. A poster clasp for suspending a poster therefrom, comprising:

a suspension assembly having at least one suspension device for operable, suspending cooperation with a surface; and a clasp assembly being formed integrally, unitarily with the suspension assembly, the clasp assembly having a support member and a hinged gripping member, the support member having a cam point formed integral with a backplate, and the hinged gripping member having a hingedly rotatable compression fin, the compression fin being rotatable between an open disposition and a closed disposition, the compression fin being formed integral with a hinge and being formed of a relatively soft material wherein the hinge and the cam point are each formed of a material having a durometer number, the durometer number of the hinge and of the cam point being substantially the same, said durometer number being less than a durometer number of the backplate.

2. The post clasp of claim 1 wherein the compression fin forms in part a funnel leading to an opening defined in cooperation with the backplate, the funnel being formed when the compression fin is in an open disposition.

3. The poster clasp of claim 1 wherein the cam point presents a raised surface relative to a backplate surface.

4. The poster clasp of claim 1, the hinge being formed integral with the support member and the hinged gripping member and rotatably coupling the hinged gripping member to the support member.

5. The post clasp of claim 1 wherein the binge and the compression fin are each co-extruded with the support member.

6. The poster clasp of claim 1 wherein the compression fin includes a fin leg operably coupled at a proximal end to the hinge and is operably coupled at a distal end to a foot.

7. The poster clasp of claim 6 wherein the compression fin foot presents an engaging toe, the toe being disposed to compressively engage poster stock when the compression fin is disposed in a closed disposition.

8. The poster clasp of claim 7 wherein a holding pressure is exerted on poster stock cooperatively by the engaging toe and the cam point when the compression fin is disposed in a closed disposition.

9. The poster clasp of claim 8 wherein the compression fin is over center relative to the cam point when the compression fin is in the closed disposition.

* * * * *